US011518584B2

(12) United States Patent
Meyers

(10) Patent No.: US 11,518,584 B2
(45) Date of Patent: Dec. 6, 2022

(54) DRINKING VESSEL WITH SELECTABLE DRINKING MODE

(71) Applicant: Runway Blue, LLC, Alpine, UT (US)

(72) Inventor: David O. Meyers, Layton, UT (US)

(73) Assignee: Runway Blue, LLC, Alpine, UT (US)

( * ) Notice: Subject to any disclaimer, the term of this patent is extended or adjusted under 35 U.S.C. 154(b) by 171 days.

(21) Appl. No.: 16/855,899

(22) Filed: Apr. 22, 2020

(65) Prior Publication Data

US 2020/0339314 A1 Oct. 29, 2020

Related U.S. Application Data

(60) Provisional application No. 62/838,109, filed on Apr. 24, 2019.

(51) Int. Cl.

| | |
|---|---|
| ***B65D 47/26*** | (2006.01) |
| ***A47G 19/22*** | (2006.01) |
| ***B65D 43/02*** | (2006.01) |

(52) U.S. Cl.

CPC ..... *B65D 47/263* (2013.01); *A47G 19/2222* (2013.01); *A47G 19/2272* (2013.01); *B65D 43/0204* (2013.01); *B65D 2547/063* (2013.01)

(58) Field of Classification Search

CPC ..... B65D 47/263; B65D 43/0204; B65D 2547/063; B65D 47/265; B65D 47/261;

(Continued)

(56) References Cited

U.S. PATENT DOCUMENTS

| | | | |
|---|---|---|---|
| 3,170,633 | A | 2/1965 | Castelli |
| 3,937,364 | A | 2/1976 | Wright |

(Continued)

FOREIGN PATENT DOCUMENTS

| | | |
|---|---|---|
| CN | 101730492 | 6/2010 |
| CN | 101730651 | 6/2010 |

(Continued)

OTHER PUBLICATIONS

International Search Report and Written Opinion of the International Searching Authority in International Application No. PCT/US2020/029355, dated Aug. 10, 2020 (14 pages).

*Primary Examiner* — John K Fristoe, Jr.
*Assistant Examiner* — Eric C Baldrighi
(74) *Attorney, Agent, or Firm* — Sterne, Kessler, Goldstein & Fox P.L.L.C.

(57) ABSTRACT

A drinking vessel with selectable modes includes a lid, a straw, and a container. The lid extends over an upper opening of the container. The lid includes a lid upper portion and a lid base. The lid upper portion defines a drinking passage therethrough, the drinking passage disposed at an upper rim of the lid upper portion. The lid base defines a first fluid passage therethrough and a second fluid passage therethrough. The straw is coupled to a bottom side of the second fluid passage. The lid upper portion is rotatable through at least three positions relative to the lid base. In the first position the drinking passage does not align with either the first fluid passage or the second fluid passage. In the second position the drinking passage aligns with the first fluid passage. In the third position the drinking passage aligns with the second fluid passage.

23 Claims, 11 Drawing Sheets

FIG. 2

(58) Field of Classification Search
CPC ..... A47G 19/2222; A47G 19/2272; A47G 19/2266
USPC ..... 215/229
See application file for complete search history.

(56) References Cited

U.S. PATENT DOCUMENTS

| | | | |
|---|---|---|---|
| 4,286,636 | A | 9/1981 | Credle |
| 4,768,667 | A | 9/1988 | Magnusson |
| D308,828 | S | 6/1990 | Magnusson |
| 4,976,364 | A | 12/1990 | Solomon |
| D339,503 | S | 9/1993 | Callaway |
| 5,326,006 | A | 7/1994 | Giard, Jr. |
| D350,672 | S | 9/1994 | Egger et al. |
| 5,545,315 | A | 8/1996 | Lonneman |
| D391,448 | S | 3/1998 | Winer et al. |
| D398,478 | S | 9/1998 | Spencer |
| 5,984,141 | A | 11/1999 | Gibler |
| D427,909 | S | 7/2000 | Doritty et al. |
| 6,135,311 | A | 10/2000 | Panec et al. |
| 6,523,711 | B1 | 2/2003 | Hughes et al. |
| 6,971,551 | B2 | 12/2005 | Widgery |
| 7,204,382 | B2 | 4/2007 | Cezeaux |
| D586,183 | S | 2/2009 | Junkel |
| D600,973 | S | 9/2009 | Lane |
| D608,204 | S | 1/2010 | Caroen et al. |
| D608,640 | S | 1/2010 | Carreno |
| 7,651,003 | B2 | 1/2010 | Albers et al. |
| D609,969 | S | 2/2010 | McKinney |
| 7,775,394 | B2 | 8/2010 | Naesje |
| D626,409 | S | 11/2010 | Hooley |
| 8,051,674 | B2 | 11/2011 | Roth et al. |
| D655,569 | S | 3/2012 | Lipson |
| D657,194 | S | 4/2012 | McIntire et al. |
| D660,081 | S | 5/2012 | Gilbert |
| 8,272,525 | B1 | 9/2012 | La Torre et al. |
| 8,336,724 | B2 | 12/2012 | Yamashita et al. |
| D675,865 | S | 2/2013 | Wahl |
| 8,505,783 | B2 | 8/2013 | Gill et al. |
| 8,505,793 | B2 | 8/2013 | Foley |
| D689,331 | S | 9/2013 | Staton |
| D690,162 | S | 9/2013 | Staton |
| D690,556 | S | 10/2013 | Boroski |
| D691,420 | S | 10/2013 | McIntire |
| 8,602,238 | B2 | 12/2013 | El-Saden et al. |
| 8,695,836 | B1 | 4/2014 | Gregory |
| D707,492 | S | 6/2014 | George et al. |
| D724,895 | S | 3/2015 | Kawase et al. |
| D725,436 | S | 3/2015 | Miller |
| D725,967 | S | 4/2015 | Peng |
| D736,562 | S | 8/2015 | Green et al. |
| D760,027 | S | 6/2016 | Meyers et al. |
| 9,498,086 | B2 | 11/2016 | Waggoner et al. |
| 9,694,953 | B2 | 7/2017 | Meyers et al. |
| 10,246,228 | B2 | 4/2019 | Meyers et al. |
| 2003/0168474 | A1 | 9/2003 | Widgery |
| 2004/0188280 | A1 | 9/2004 | Young |
| 2005/0115966 | A1 | 6/2005 | Leoncavallo et al. |
| 2005/0121405 | A1 | 6/2005 | Drajan |
| 2006/0283896 | A1 | 12/2006 | Kasting |
| 2008/0142519 | A1 | 6/2008 | Chou |
| 2010/0108700 | A1 | 5/2010 | Scott |
| 2010/0123019 | A1 | 5/2010 | Zehavi |
| 2010/0270337 | A1 | 10/2010 | Green et al. |
| 2011/0248054 | A1 | 10/2011 | Darby |
| 2012/0012617 | A1 | 1/2012 | Gill et al. |
| 2012/0187157 | A1 | 7/2012 | Yuan |
| 2013/0214012 | A1 | 8/2013 | Pils et al. |
| 2014/0263476 | A1 | 9/2014 | Blain et al. |
| 2014/0319183 | A1 | 10/2014 | Choi et al. |
| 2015/0114964 | A1 | 4/2015 | Vogel et al. |
| 2015/0164254 | A1 | 6/2015 | Niedens |
| 2015/0196148 | A1 | 7/2015 | Hoskins |
| 2015/0210443 | A1 | 7/2015 | Sarson |
| 2015/0223623 | A1 | 8/2015 | Davis |
| 2016/0150898 | A1 | 6/2016 | Hoskins |
| 2016/0200486 | A1 | 7/2016 | Meyers et al. |
| 2018/0050844 | A1* | 2/2018 | Hirst ..... A47G 21/18 |

FOREIGN PATENT DOCUMENTS

| | | |
|---|---|---|
| CN | 102099251 | 6/2011 |
| GB | 1080873 A | 8/1967 |
| JP | 5761272 U | 4/1982 |
| KR | 200190169 | 7/2000 |
| WO | WO 2005/032948 | 4/2005 |
| WO | WO 2007/069257 | 6/2007 |
| WO | WO 2008084256 | 7/2008 |
| WO | WO 2016111736 | 7/2016 |
| WO | WO 2018034731 | 2/2018 |

* cited by examiner

DRINKING VESSEL WITH SELECTABLE DRINKING MODE

CROSS-REFERENCE TO RELATED APPLICATIONS

This application claims the benefit of U.S. Provisional Patent Application No. 62/838,109, filed Apr. 24, 2019, which is incorporated herein in its entirety by reference thereto.

FIELD

This disclosure generally relates to drinking vessels for beverages. More specifically, some embodiments relate to drinking vessels with mechanisms for selecting drinking modes.

BACKGROUND

Drinking vessels for beverages may include a spout for a user to consume a beverage through. Some users may favor consuming a beverage using a straw. Some users may favor consuming a beverage without using a straw.

SUMMARY

Some embodiments described herein are directed to a drinking vessel with selectable modes, including a lid, a straw, and a container. The lid is disposed over an upper opening of the container. The lid includes a lid upper portion and a lid base. The lid upper portion defines a drinking passage therethrough, the drinking passage disposed at an upper rim of the lid upper portion. The lid base has a first fluid passage and a second fluid passage. The straw is in fluid communication with the second fluid passage. The lid upper portion is rotatable through at least three positions relative to the lid base. In the first position the drinking passage does not align with either the first fluid passage or the second fluid passage. In the second position the drinking passage aligns with the first fluid passage. In the third position the drinking passage aligns with the second fluid passage.

Some embodiments described herein are directed to a drinking vessel with selectable modes, including a container for containing a beverage and a lid disposed on and extending over an upper opening of the container. The lid is configurable into at least three modes. In the first mode the drinking spout is not in communication with an interior of the container and the interior of the container is closed relative to an atmosphere outside of the container. In the second mode the drinking spout is in direct fluid communication with an interior of the container at a position directly below the lid. In the third mode the drinking spout is in fluid communication with a straw coupled to the lid and extending downwardly within the container below the lid. To transition from the first mode to the third mode, the lid must be configured in the second mode before reaching the third mode.

Some embodiments described herein are directed to a drinking vessel with selectable modes, including a tumbler and a lid covering an upper opening of the tumbler. The lid includes a single drinking spout. In a first drinking mode, the drinking spout is in fluid communication with an interior of the tumbler via a straw coupled to a bottom side of the lid. In a second drinking mode, the drinking spout is in fluid communication with the interior of the tumbler not via a straw.

Some embodiments described herein are directed to a drinking vessel with selectable modes, including a container having an upper opening and a lid disposed over the upper opening. The lid includes a lid base having a first fluid passage and a second fluid passage, a lid upper portion defining a drinking passage extending therethrough, a straw in fluid communication with the second fluid passage, and an internal gasket disposed between the lid upper portion and the lid base, the internal gasket defining an opening surrounding a bottom end of the drinking passage. The lid upper portion is rotatable through at least three positions relative to the lid base. In the first position the drinking passage does not align with either the first fluid passage or the second fluid passage, in the second position the drinking passage aligns with the first fluid passage, and in the third position the drinking passage aligns with the second fluid passage. The internal gasket rotates with the lid upper portion, relative to the lid base.

Some embodiments described herein are directed to a drinking vessel with selectable modes, including a container having an upper opening, and a lid disposed over the upper opening of the container. The lid includes a lid upper portion defining a drinking passage therethrough, the drinking passage disposed at an upper rim of the lid upper portion. The lid also includes a lid base having a fluid passage. The lid upper portion is rotatable through at least two positions relative to the lid base. In the first position the drinking passage does not align with the fluid passage, and in the second position the drinking passage aligns with the fluid passage.

BRIEF DESCRIPTION OF THE FIGURES

The accompanying drawings, which are incorporated herein and form a part of the specification, illustrate the present disclosure and, together with the description, further serve to explain the principles thereof and to enable a person skilled in the pertinent art to make and use the same.

DETAILED DESCRIPTION

Figure 1:
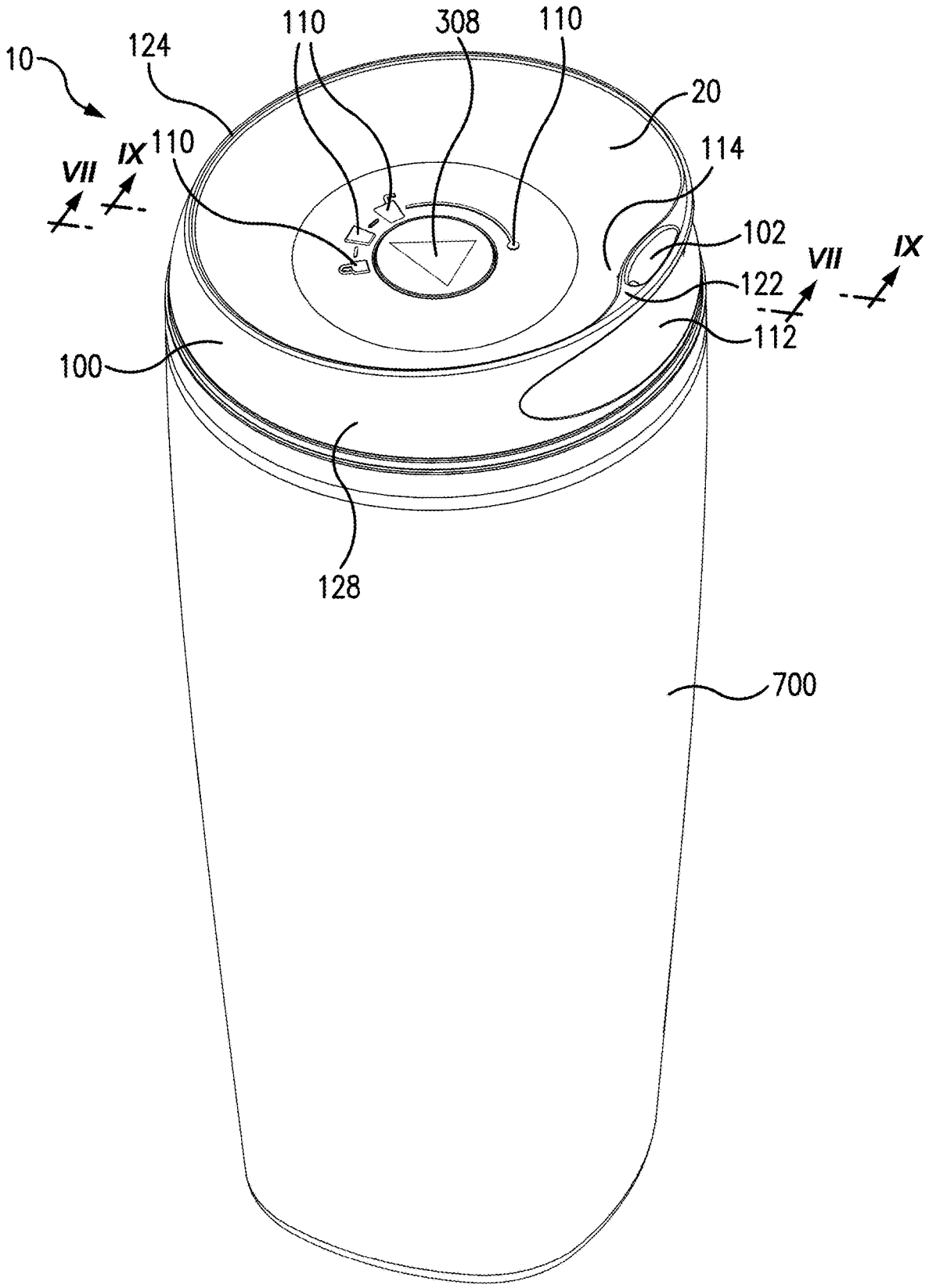
FIG. 1 shows an upper perspective view of a drinking vessel.

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein comport with standards used by those experienced or skilled in the art to most effectively convey the substance of their work to others skilled in the art. In some instances, well-known methods, procedures, components, and elements have not been described in detail to avoid unnecessarily obscuring aspects of the disclosure.

References in the specification to "one embodiment," "an embodiment," "an example embodiment," "some embodiments," etc., indicate that the embodiment described may include a particular feature, structure, or characteristic, but every embodiment may not necessarily include the particular feature, structure, or characteristic. Moreover, such phrases are not necessarily referring to the same embodiment. Further, this disclosure has been prepared such that when a particular feature, structure, or characteristic is described in connection with an embodiment, it is within the knowledge of one skilled in the art to apply such feature, structure, or characteristic in connection with other embodiments whether or not explicitly described.

The following examples are illustrative, but not limiting, of the present disclosure. Other suitable modifications and adaptations of the variety of conditions and parameters normally encountered in the field, and which would be apparent to those skilled in the art, are within the spirit and scope of the disclosure.

People often may want to carry a beverage with them, for consumption on their own terms. Rather than using a single-use (e.g., disposable or recyclable) bottle, a person may want a reusable vessel to contain their beverage. However, some people may have different preferences as to how they drink different beverages. For example, the same person may like to drink their iced tea through a straw and also may like to drink their coffee by sipping it without a straw. This has often meant that that person needed two different types of vessels to transport their beverages, according to which type of beverage they were transporting. Or that person had to drink a beverage in a way that they do not prefer.

Some embodiments of the present disclosure provide a single drinking vessel that can be used both to drink a beverage through a straw and to drink a beverage without a straw, using the same spout. A person can thus rely on a single vessel having a single lid for multiple modes of drinking. As will be described in more detail below, the exemplifying drinking vessel illustrated herein has a spout situated near an edge of its lid. In a first drinking mode, the user can just tilt the vessel up to pour its beverage out from the spout and into the user's mouth. In a second drinking mode, the user can simply suck the beverage up through the spout connected to a straw, while keeping the vessel upright.

The spout is situated on an edge of the vessel's lid, so it is in a familiar and comfortable position for both the first drinking mode and the second drinking mode. For example, if a user were drinking from a tumbler-style drinking cup without a straw, the user would drink from an edge of the cup. If the user were drinking from the tumbler-style drinking cup with a straw, the straw would naturally lean against an edge of the cup.

The lid may have parts that rotate relative to each other, to move between drinking modes. For example, the lid may have a lid base and a lid upper portion. The lid upper portion may include the spout mentioned above. The lid base may have multiple fluid passages. One fluid passage may extend through the lid base and open on its bottom side into the container. The other may be connected to a straw on its bottom side, the straw extending to nearly a bottom of the vessel. A user may rotate the lid upper portion to align a drinking passage with either of the lid base's fluid passages, according to which mode the user wants to use to drink.

The lid may also include a position where it is closed (e.g., the drinking passage aligns with no fluid passage into the vessel) and a position where it can be disassembled (e.g., for cleaning). In the closed position, the lid may be sealed. The lid may include other parts and features that help a user to know which mode is selected. For example, as a user turns the lid upper portion, the user may feel a click or other tactile feedback when the lid parts are aligned for a certain drinking mode.

These and other embodiments are discussed below in more detail with reference to the figures.

FIG. 1 shows a drinking vessel 10 according to some embodiments. Drinking vessel 10 may include a lid 20 and a container 700. Lid 20 may include multiple components, including a lid upper portion 100. Lid upper portion 100 may include a drinking passage 102 through which a user can drink a beverage contained within drinking vessel 10.

Lid upper portion 100 may be rotatable relative to container 700 to select a drinking mode of drinking vessel 10. Lid upper portion 100 may also rotate relative to an indicator 308, which may be disposed centrally within an opening of lid upper portion 100 as shown for example in FIG. 1. Indicator 308 (e.g., a triangle as shown in FIG. 1 or another graphical feature, such as a logo) may point to a selection indicium 110, which can indicate to a user which mode of vessel 10 is currently selected. For example, in FIG. 1 there are shown four selection indicia 110, one for each of a closed mode (indicated by a selection indicium 110 depicting a lock), a first drinking mode (indicated by a selection indicium 110 depicting a cup), a second drinking mode (indicated by a selection indicium 110 depicting a cup with a straw), and a disassembly mode (indicated by a selection indicium 110 depicting a dot). In FIG. 1 the first drinking mode is selected.

Figure 2:
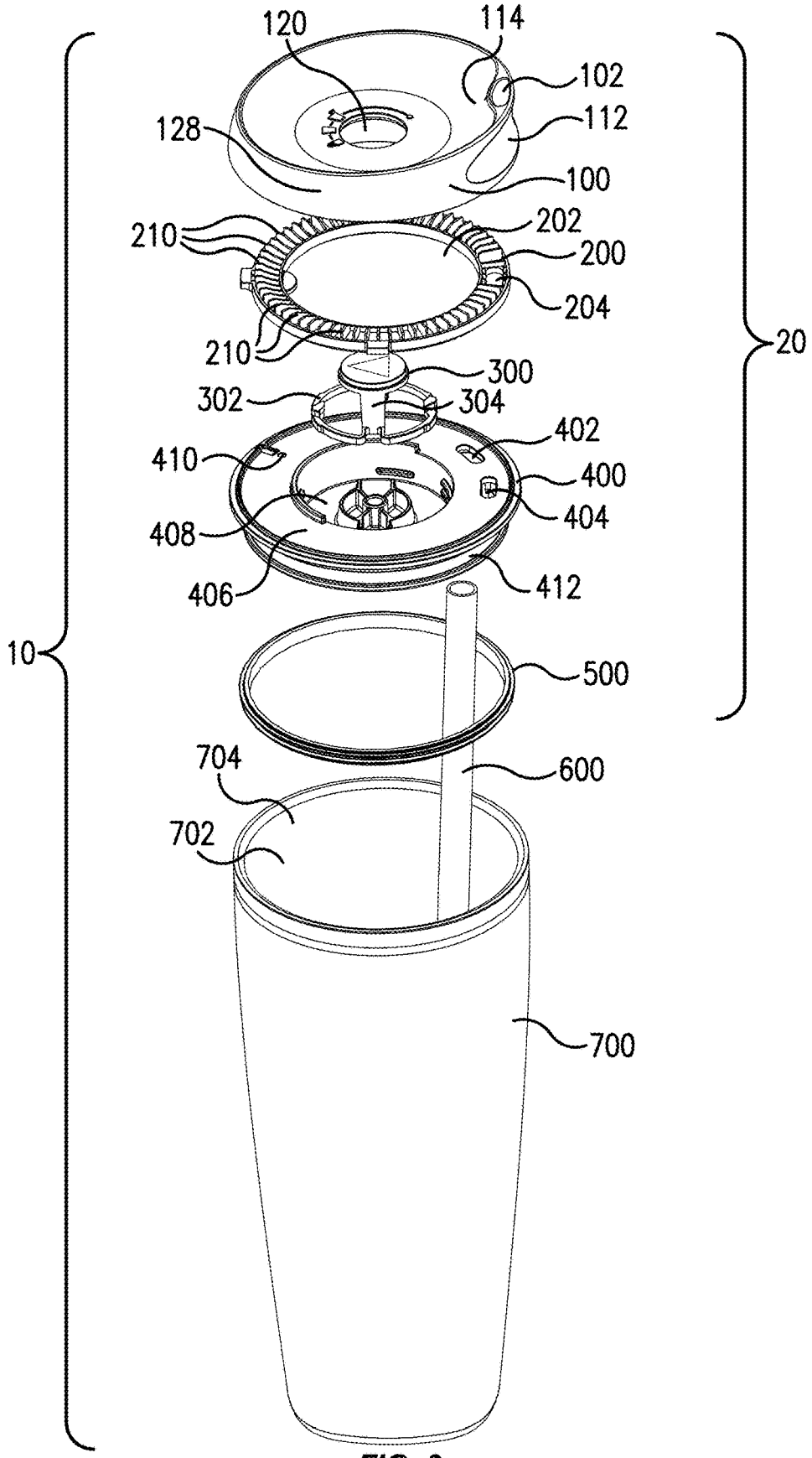
FIG. 2 shows an exploded upper perspective view of the drinking vessel of FIG. 1
Figure 3:
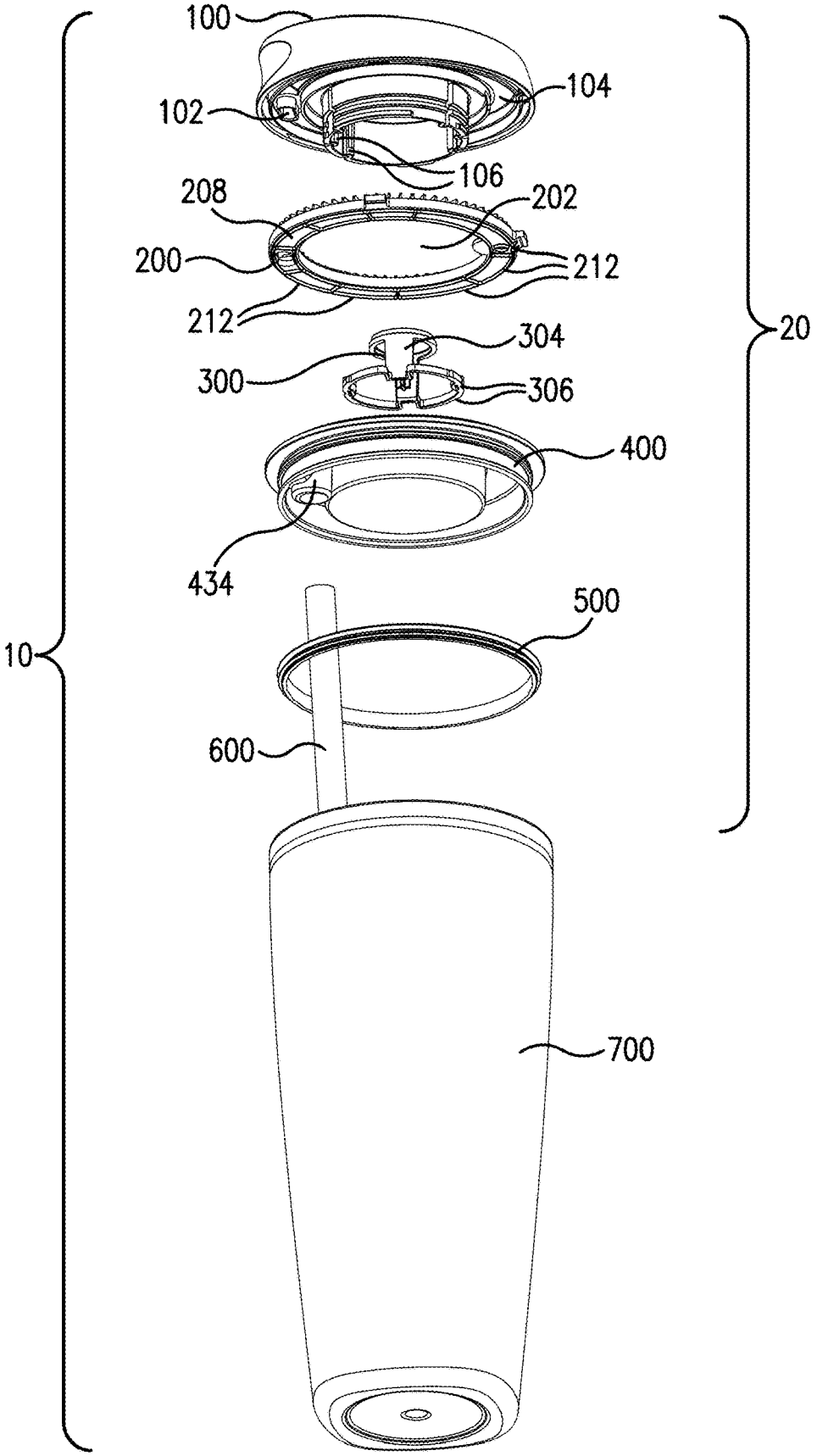
FIG. 3 shows an exploded lower perspective view of the drinking vessel of FIG. 1.

FIGS. 2 and 3 show exploded views of drinking vessel 10 according to some embodiments. As shown, lid 20 includes lid upper portion 100, as well as an internal gasket 200, a selector spring 300, a lid base 400, and an outer (external) gasket 500. Outer gasket 500 may fit around an outer side surface 412 of lid base 400, and when assembled with container 700, outer gasket 500 may be pressed between lid base 400 and an inner surface 704 of container 700, to create a seal between lid 20 and container 700. Outer gasket 500 may also create an interference fit, promoting friction between container 700 and lid base 400, such that lid base 400 does not rotate relative to container 700.

Lid base 400 may have a platform 406 defined at least in part by revolving a line partially or completely around an axis. The illustrated platform 406 has a flat upper surface, which has an annular shape extending from near an outer edge of lid base 400 inwardly toward a central recess 408 of lid base 400. Lid base 400 may define two fluid passages that each open to platform 406: a first fluid passage 402 that passes through lid base 400 and opens into container 700 when assembled, and a second fluid passage 404 that passes through lid base 400 and fluidly communicates with a straw 600 when assembled or formed together. Straw 600 may be contained entirely within drinking vessel 10. This can help simplify sealing of drinking vessel 10, and can keep straw 600 hidden and unobtrusive to a user.

Selector spring 300 may be disposed between lid base 400 and lid upper portion 100, and may be rotatably restrained in position relative to lid base 400 such that selector spring 300 does not rotate relative to lid base 400. Selector spring 300 may be disposed within a recess 408, which may be centrally located in lid base 400. Selector spring 300 may have deflection arms 302 that extend out from the base of a central column 304 of selector spring 300. Deflection arms 302 may each form an arc, in some cases corresponding to segments of a circular shape.

Internal gasket 200 may be disposed between lid upper portion 100 and platform 406 of lid base 400. Internal gasket 200 may have an annular shape, for example as illustrated in FIG. 2. Internal gasket 200 may be received within a recess 104 of lid upper portion 100 when assembled. Internal gasket 200 may be rotatably restrained in position relative to lid upper portion 100. That is, internal gasket 200 may rotate along with lid upper portion 100 relative to lid base 400. Internal gasket 200 may slide along platform 406 of lid base 400 during such rotation. Internal gasket 200 may have a drinking passage opening 204, which may be disposed around a bottom end of drinking passage 102 of lid upper portion 100 when assembled.

Container 700 may be any type of container. As shown in FIGS. 1-3, for example, container 700 can be a tumbler. Container 700 may have a tapering, frustoconical or other exterior shape. A container and lid that work together without an attachment mechanism (e.g., threads) at an upper edge of the container—such as the illustrated container 700 and lid 20 for example—may provide additional flexibility to a user. In other words, container 700 may have a smooth interior surface at its connection to lid 20. In this way, a user can use container 700 without lid 20 if desired. In some such embodiments, container 700 may be used as a normal tumbler. In some embodiments, container 700 may be double-walled to enhance thermal insulative properties of container 700. In some embodiments, an area between container 700's double walls may be hermetically sealed and may form at least a partial vacuum. In some embodiments, container 700 may be formed of stainless steel. In some embodiments, container 700 may be formed of another food-grade material, such as a food-grade plastic (e.g., polypropylene, copolyester, the copolymer sold as Eastman Tritan, high-density polyethylene (HDPE), polyoxymethylene (POM), or acrylonitrile butadiene styrene (ABS)), glass, or another metal (e.g., steel, aluminum, copper, or titanium).

Figure 4:
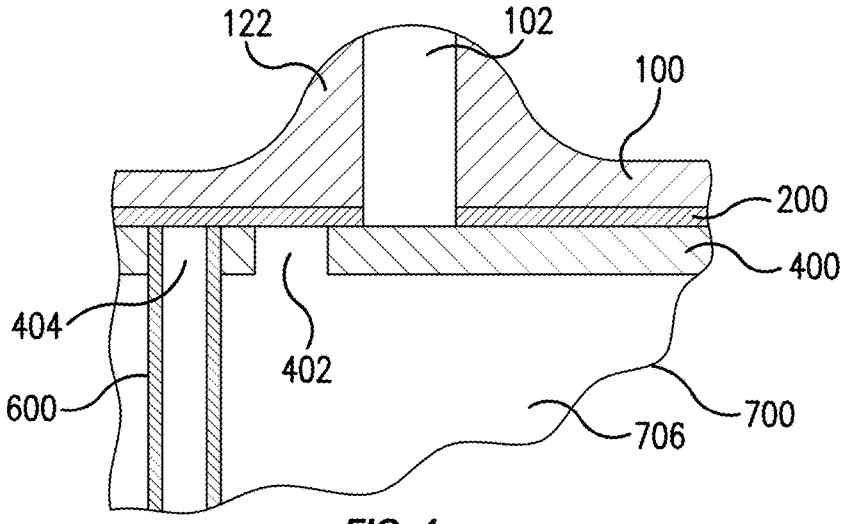
FIG. 4 shows a schematic vertical sectional view of a portion of the drinking vessel of FIG. 1 in a closed mode.
Figure 5:
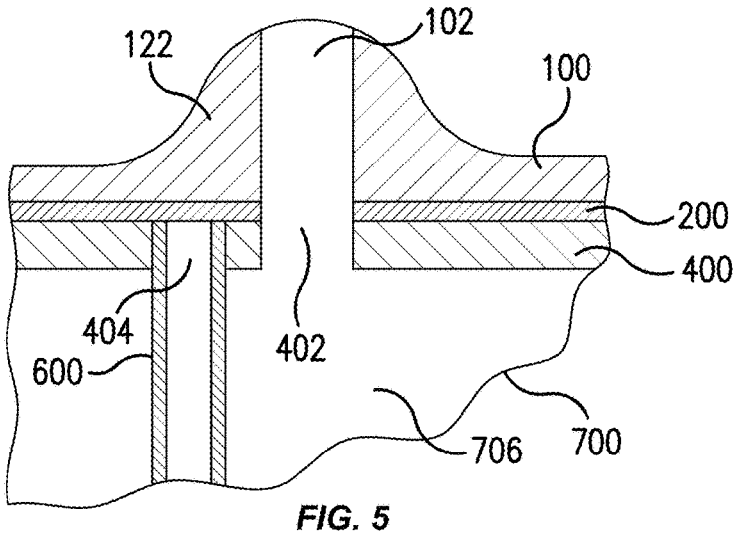
FIG. 5 shows a schematic vertical sectional view of a portion of the drinking vessel of FIG. 1 in a first drinking mode.
Figure 6:
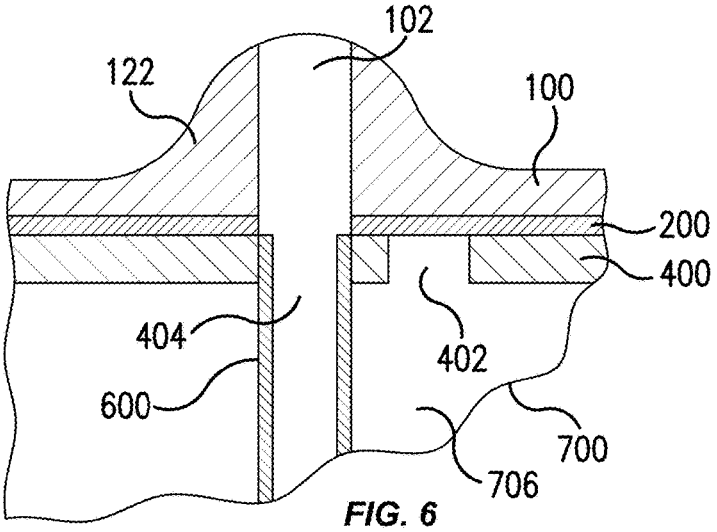
FIG. 6 shows a schematic vertical sectional view of a portion of the drinking vessel of FIG. 1 in a second drinking mode, which employs a straw.

FIGS. 4-6 are schematic sectional views showing relative positions of certain components of drinking vessel 10 during operation. These figures illustrate portions of lid upper portion 100, internal gasket 200, lid base 400, and straw 600 when lid 20 is in a closed mode (FIG. 4), a first drinking mode (FIG. 5), and a second drinking mode (FIG. 6).

As mentioned above, during operation a user may move (e.g., rotate) lid upper portion 100 relative to lid base 400 to select between modes of drinking vessel 10. FIGS. 4-6 show relative positions of these components as they move through modes. In FIG. 4—showing a closed mode of drinking vessel 10—lid upper portion 100 is in a first position relative to lid base 400. In this first position, drinking passage 102 is not open to an interior 706 of container 700. To the contrary, drinking passage 102 is closed by platform 406 of lid base 400. Internal gasket 200 disposed between lid upper portion 100 and lid base 400 can create a seal between drinking passage 102 and interior 706 of container 700. In this first, closed position interior 706 is preferably sealed relative to an atmosphere outside of interior 706, such that any liquid within interior 706 remains contained within interior 706 no matter the orientation of drinking vessel 10.

As a user moves lid upper portion 100 relative to lid base 400, drinking passage 102 moves toward first fluid passage 402 of lid base 400, until lid upper portion 100 reaches a second position—represented in FIG. 5 for example—in which drinking passage 102 is aligned with first fluid passage 402. When reaching this second position, a user may receive feedback that lid upper portion 100 is correctly aligned in the second position (e.g., with a tactile and/or audible click, discussed more below). In the second position, drinking vessel 10 is in a first drinking mode; drinking passage 102 is in fluid communication with an upper area of interior 706 of container 700. As shown in FIG. 5, drinking passage 102 and first fluid passage 402 together form a direct passage to and open into interior 706 just below lid base 400. In an upright orientation, such direct passage would open into air that is disposed above any liquid contained within interior 706.

In the second position, with drinking vessel in the first drinking mode, a user may tilt drinking vessel 10 in the direction of drinking passage 102 to cause a beverage within interior 706 to pour out of drinking vessel 10 through drinking passage 102 and into the user's mouth for consumption, similarly to how the user might drink from the upper edge of a tumbler cup. Or, if the user does not prefer to drink the beverage in a first drinking mode, without a straw, the user can continue to move lid upper portion 100 relative to base 400 to move drinking passage 102 toward second fluid passage 404 of lid base 400, until lid upper portion 100 reaches a third position—represented in FIG. 6 for example—in which drinking passage 102 is aligned with second fluid passage 404.

Similarly to the second position, when reaching this third position, the user may receive feedback that lid upper portion 100 is correctly aligned in the third position. In the third position, drinking vessel 10 is in a second drinking mode, which employs a straw; drinking passage 102 is in fluid communication with a lower area of interior 706 of container 700, via straw 600. Straw 600 is coupled to second fluid passage 404 of lid base 400, and extends down into interior 706 to open into interior 706 at or near a bottom of interior 706. In an upright orientation, a lower end of straw 600 could be submerged in liquid contained within interior 706.

In the third position, with drinking vessel 10 in the second drinking mode, a user may suck on drinking passage 102, which suction will be transmitted through drinking passage 102, through straw 600, and into liquid contained within interior 706. This will cause such liquid to be drawn up through straw 600 and drinking passage 102 into the user's mouth for consumption, similarly to how a user might drink from a cup using a straw.

As shown in FIGS. 4-6, the closed mode is separated from the second drinking mode by the first drinking mode. In other words, when lid 20 is in the closed mode, lid upper portion 100 must move through the first drinking mode to get to the second drinking mode. In some uses, a user might seal a liquid (e.g., a hot or carbonated beverage) within drinking vessel 10 that may build up pressure within drinking vessel 10 (e.g., by heating air above the liquid, causing the air to expand, or by giving off a gas such as $CO_2$) while the vessel is in the closed mode, in which it may be sealed. By making the first drinking mode a necessary intermediate mode before reaching the second drinking mode from the closed mode, such pressure is released neatly by venting gas (in the normal circumstance where the vessel's liquid contents are positioned below a lowest part of the first fluid passage 402), since in the first drinking mode drinking passage 102 is in communication with an area above any contained liquid. This avoids or reduces the likelihood of pressure buildup being relieved through a straw in the second drinking mode, which could force liquid out through a drinking opening before a user is ready to drink, potentially creating a mess.

Figure 7:
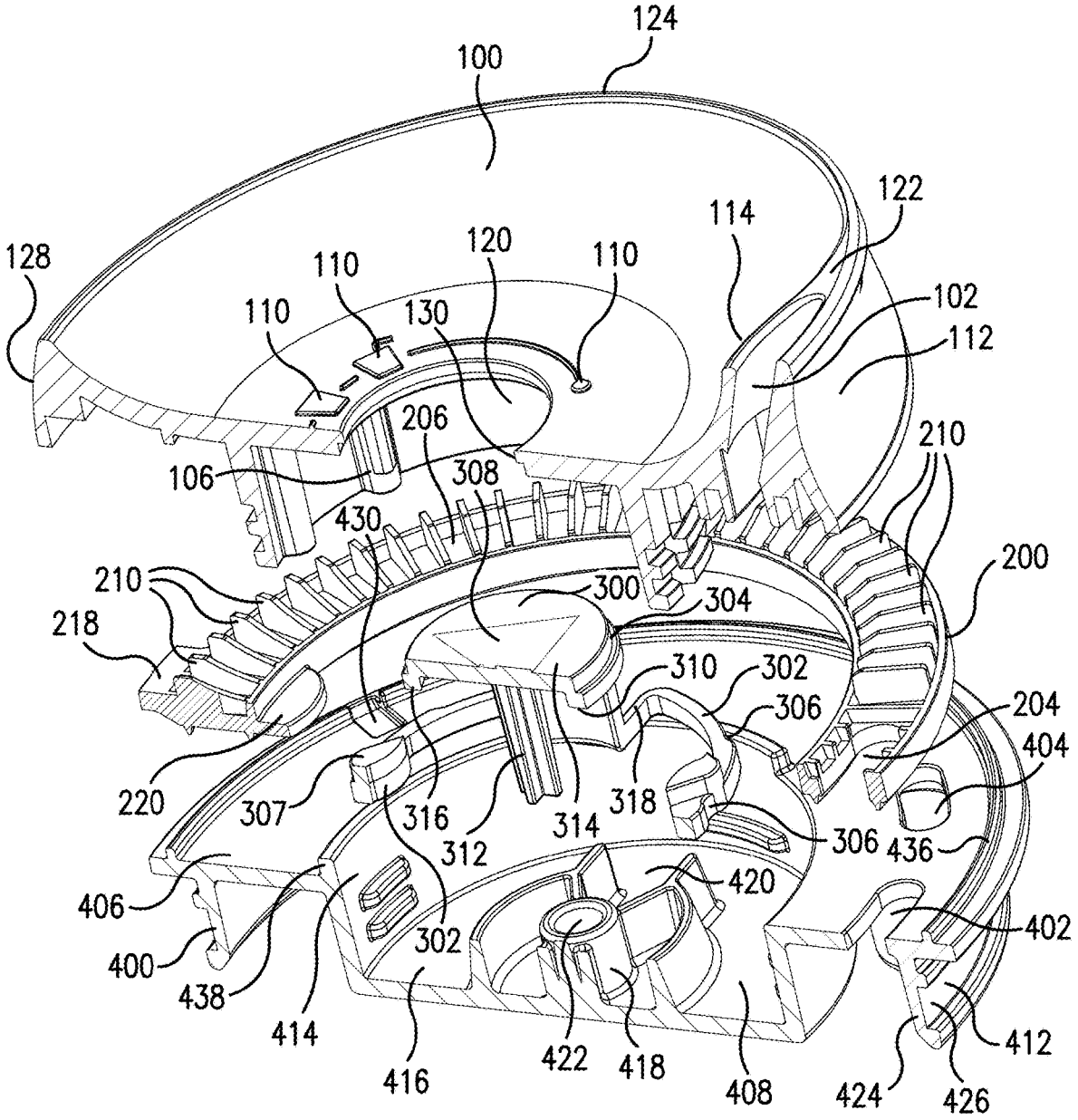
FIG. 7 shows an exploded sectional upper perspective view of a portion of the drinking vessel of FIG. 1, taken at the position of line VII-VII of FIG. 1.
Figure 8:
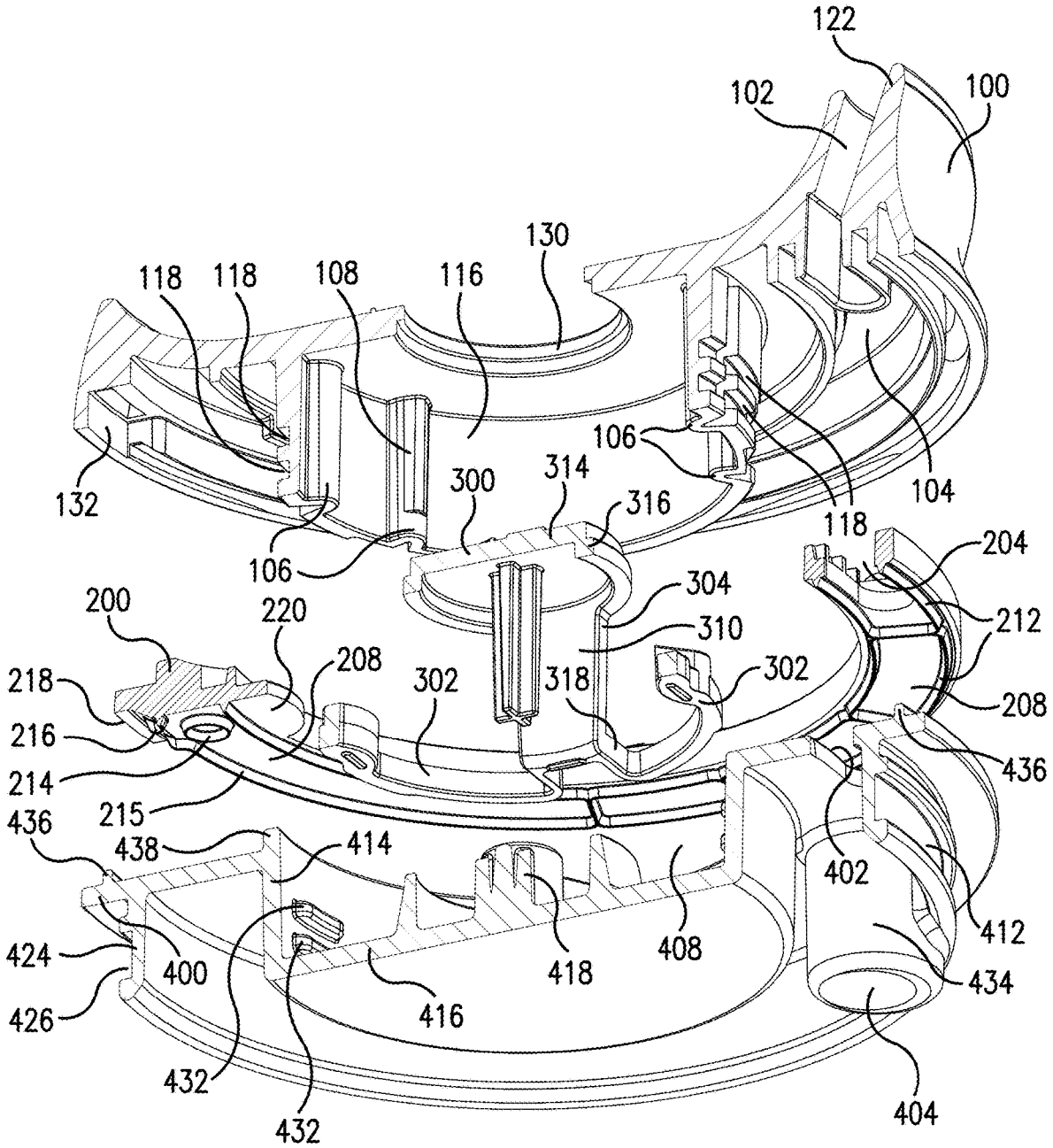
FIG. 8 shows an exploded sectional lower perspective view of a portion of the drinking vessel of FIG. 1, taken at the position of line VII-VII of FIG. 1.
Figure 9:
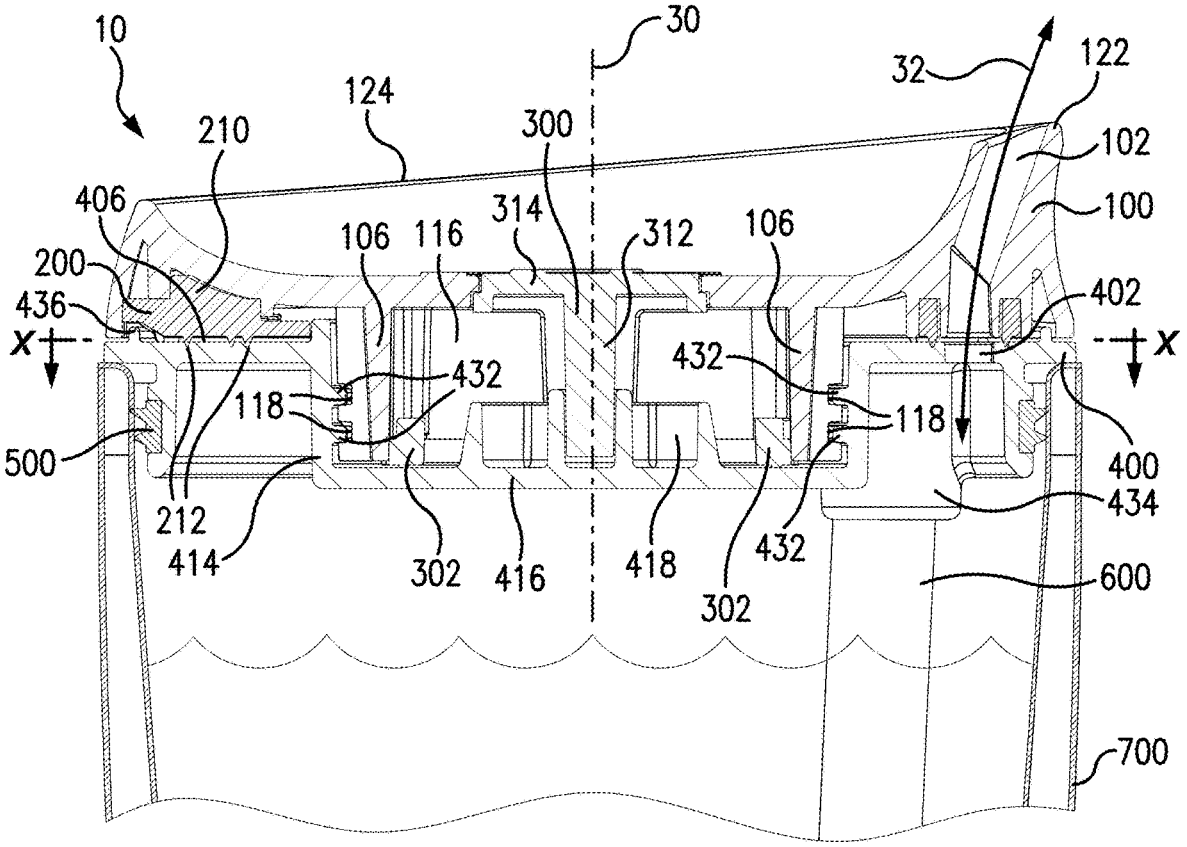
FIG. 9 shows a sectional view of a portion of the drinking vessel of FIG. 1, taken at the position of line IX-IX of FIG. 1.

FIGS. 7-9 show detailed views of an embodiment for implementing some features as have been described. The specific structures and mechanisms shown and described (here and anywhere else in this document) may not be the only way to accomplish the functions described, and each element may be implemented using other shapes, structures, and appearances than specifically shown and described.

FIGS. 7 and 8 show exploded cross-sectional views of lid upper portion 100, interior gasket 200, selector spring 300, and lid base 400. The section in FIGS. 7 and 8 is taken vertically, and is offset toward the foreground from a central vertical axis of lid 20. FIG. 7 shows an upper perspective view, and FIG. 8 shows a lower perspective view. FIG. 9 shows an assembled cross-sectional view of an upper portion of drinking vessel 10. The section in FIG. 9 is taken along a central vertical axis of drinking vessel 10, aligned through drinking passage 102 while drinking vessel 10 is in the first drinking mode (i.e., the second position discussed above, where drinking passage 102 is aligned with first fluid passage 402 (the non-straw passage)).

Lid upper portion 100, internal gasket 200, selector spring 300, lid base 400, outer gasket 500, and container 700 all share a common central vertical axis 30 (see FIG. 9). This is the axis about which the illustrated lid upper portion 100 and internal gasket 200 rotate relative to selector spring 300 and lid base 400. Lid base 400 may be formed of food-grade plastic (e.g., polypropylene, copolyester, the copolymer sold as Eastman Tritan, high-density polyethylene (HDPE), polyoxymethylene (POM), or acrylonitrile butadiene styrene (ABS)), glass, or metal (e.g., steel, stainless steel, aluminum, copper, or titanium), and may be formed as a single, unitary piece. As shown, for example, in FIG. 7, lid base 400 includes a flat platform 406 through which first fluid passage 402 and second fluid passage 404 extend, as mentioned above. As shown, lid base 400 also includes an inner cylindrical wall 414 that extends downward from an inner side of platform 406. A floor 416 extends across and closes a bottom of inner cylindrical wall 414. Together, inner cylindrical wall 414 and floor 416 define central recess 408 of lid base 400.

On and extending up from floor 416, lid base 400 includes a locating structure 418. Locating structure 418 is formed of a shape to receive cooperating features of selector spring 300, to help maintain selector spring 300 in position centrally within recess 408, and to constrain selector spring 300 from moving (e.g., rotating) relative to lid base 400. For example, as shown in the figures, locating structure 418 has an opposing pair of outer receiving grooves 420, which receive opposing column flanges 310 of selector spring 300. Sides of receiving grooves 420 contact sides of column flanges 310, preventing selector spring 300 from rotating relative to lid base 400. Locating structure 418 also may include a receiving cylinder 422, which may receive a support 312 of selector spring 300. Receiving cylinder 422 may share central vertical axis 30, and may thus limit movement of selector spring 300 and help to locate selector spring 300 on lid base 400 centrally within recess 408 (e.g., during a user's assembly operation).

Extending down from platform 406, lid base 400 includes an outer cylindrical wall 424. Outer cylindrical wall 424 may form an outer channel 426 within which outer gasket 500 may be received (see FIG. 9).

Extending up from platform 406 in some embodiments is an outer wall 436, which may help to obscure internal features of lid 20 (e.g., gasket 200) from view when lid 20 is assembled. Also extending up from platform 406 in some embodiments is an inner wall 438, which may be formed of multiple wall segments and interruptions which co-operate with structures of lid upper portion 100 to limit rotation of lid upper portion 100. For example, inner wall 438 can cooperate with, e.g., by abutting engagement, stop 134 of lid upper portion 100 to limit relative movement of lid upper portion 100 relative to lid base 400 (see, e.g., FIGS. 10 and 13). Stop 134 may protrude downwardly from a lower side of lid upper portion 100.

First fluid passage 402 and second fluid passage 404 may extend through platform 406 at locations between inner cylindrical wall 414 and outer cylindrical wall 424. First fluid passage 402 and second fluid passage 404 may be the same size and shape, and/or may have the same cross-sectional area, to allow for a similar rate of fluid passage therethrough. As shown, first fluid passage 402 and second fluid passage 404 have a stadium shape with a slight curve along its major axis, the curve having a radius matching its distance from central vertical axis 30. First fluid passage 402 and second fluid passage 404 may have other shapes, such as circular or rectangular, for example. In some embodiments, first fluid passage 402 and second fluid passage 404 can be oblong or elongate. First fluid passage 402 and second fluid passage 404 may be disposed the same radial distance from central vertical axis 30. This positioning helps effect their alignment with drinking passage 102 as it moves above them when lid upper portion 100 rotates.

As mentioned above, first fluid passage 402 may simply be an opening passing through platform 406, allowing liquid to traverse from interior 706 of container 700 directly through first fluid passage 402 when drinking vessel 10 is in the first drinking mode. In contrast, second fluid passage 404 is connected at its bottom end (facing interior 706 of vessel 10 when assembled) to straw 600, so that fluid flowing through second fluid passage 404 from within interior 706 first traverses through straw 600. A top end of straw 600 may fit together with a cylindrical lower portion 434 of second fluid passage 402 (e.g., by interference fit around an exterior of lower portion 434 or within an interior of lower portion 434). The cylindrical lower portion 434 may comprise a protrusion extending downwardly from platform 406. A bottom end of straw 600 may extend to or near an interior bottom surface of container 700. For example, a bottom end of straw 600 may extend close enough to the interior bottom surface of container 700 to allow adequate space between the bottom end of straw 600 and the interior bottom surface of container to allow fluid to be drawn in through straw 600 without impedance from the bottom surface. In some embodiments, a bottom end of straw 600 may be disposed within 1 inch or less of the interior bottom surface of container 700. Straw 600 may be formed of a food-grade material. For example, straw 600 may be formed of a food-grade plastic (e.g., polypropylene, copolyester, the copolymer sold as Eastman Tritan, high-density polyethylene (HDPE), polyoxymethylene (POM), or acrylonitrile butadiene styrene (ABS)), glass, or metal (e.g., steel, stainless steel, aluminum, copper, or titanium).

Lid base 400 may include a vent hole 410. Vent hole 410 is not visible in FIGS. 7-9, but can be seen, for example, in FIGS. 2 and 3, and in FIGS. 10-14, to be discussed below. Like first fluid passage 402, vent hole extends through platform 406 to open into interior 706 of container 700. Vent hole 410 may allow for fluid (e.g., gas, such as air) communication between interior 706 of container 700 and an atmosphere outside of drinking vessel 10, when drinking vessel 10 is in certain modes. For example, when drinking vessel 10 is in either of its drinking modes (i.e., the first drinking mode, with lid upper portion 100 in the second position relative to lid base 400; or the second drinking mode, with lid upper portion 100 in the third position relative to lid base 400), vent hole 410 may open at its upper end into an area beneath internal gasket 200 that is in fluid communication with an atmosphere outside of drinking vessel 10 (e.g., via a vent trench 430 recessed in platform 406 and extending radially toward an outer edge of platform 406 from a position beneath internal gasket 200 and interior relative to a portion of internal gasket 200 that seals against platform 406 in some lid positions to a position outside of or past that sealing portion of internal gasket 200, or via a discontinuity of an otherwise-closed perimeter of a lower protrusion of internal gasket 200, as will be discussed more below).

Internal gasket 200 is disposed above lid base 400, on platform 406, and may be disposed between outer wall 436 and inner wall 438, if present. Internal gasket 200 may be formed of a food-grade material suitable to create a seal between lid base 400 and lid upper portion 100. Internal gasket 200 may be flexible, and may be formed of a single, unitary piece. As mentioned above, internal gasket 200 moves with (e.g., rotates) with lid upper portion 100 relative to lid base 400. To help maintain a seal between lid base 400 and lid upper portion 100 during such relative movement, internal gasket 200 has protrusions 212 extending downward from a lower surface 208 of internal gasket 200, as shown in FIG. 8.

Protrusions 212 can form closed chambers, by defining the periphery of a closed shape that abuts lid base 400, e.g., against platform 406. The closed shapes may be sized, shaped, and positioned so as to fit around upper openings of each of first fluid passage 402 and second fluid passage 404 when in certain positions of lid upper portion 100 relative to lid base 400. As shown in FIG. 8 (and later in FIGS. 10-13), the illustrated closed shapes configured to fit around first fluid passage 402 and second fluid passage 404 are arcuate, like a curved rectangle, with short sides being straight and aligned with a shared central axis (i.e., axis 30), and with long sides forming a curve having a radius equal to their distance from the shared central axis. Not only may protrusions 212 be continuous individually (to form their closed shapes), but together protrusions 212 may be continuous extending entirely around internal gasket 200 (i.e., around a central opening 202 of gasket 200). To effect this overall continuity in the case where protrusions 212 form curved rectangular shapes as shown in the figures, each curved rectangular shape may share its short sides with short sides of its adjacent curved rectangular shapes.

Some embodiments include an open vent protrusion 215, discussed in more detail below. Open vent protrusion 215 may have a similar shape to protrusions 212, but may not form a completely closed shape. It may instead define a discontinuity (e.g., discontinuity 216) through which an interior space of open vent protrusion 215 may be in fluid communication with an external atmosphere of drinking vessel 10. Open vent protrusion 215 may help enable venting of interior 706 of container 700 to the external atmosphere (e.g., through vent hole 410).

Some embodiments include a closed vent protrusion 214, discussed in more detail below. Closed vent protrusion 214 may form a closed shape (e.g., a circle, as shown) sized to fit around vent hole 410. Depending on the mode of lid 20, closed vent protrusion 214 may be disposed around vent hole (thus sealing it) or may not be disposed around vent hole 410 (thus allowing vent hole 410 to be used to vent interior 706 of container 700). In some embodiments, closed vent protrusion 214 may be disposed within an area defined by open vent protrusion 215.

As lid upper portion 100 and internal gasket 200 together move relative to lid base 400, protrusions 212 slide across the upper surface of platform 406 of lid base 400, maintaining contact (and thus maintaining their seal) throughout such rotation.

As shown, for example, in FIG. 7, internal gasket 200 includes protrusions 210 extending upward from an upper surface 206 of internal gasket 200. Protrusions 210 comprise radial fins, for example as illustrated. Protrusions 210 fit into a gasket recess 104 of lid upper portion 100, and help to ensure that continuous pressure is applied between lid upper portion 100 and lid base 400 through internal gasket 200 while they are assembled, which pressure may be released in a disassembly position. Protrusions 210 may be evenly spaced (e.g., radially or circumferentially around central opening 202 of internal gasket 200), and may each be aligned with central vertical axis 30. The shapes of protrusions 210 can vary based on the shape of the underside of lid upper portion 100. For example, the illustrated protrusions 210, which are configured as radially extending fins, have vertical outer sides and sloping inner sides that vary fin-to-fin. The variation in shape among protrusions 210 may be to correspond to the shape of gasket recess 104 of lid upper portion 100 (see FIG. 8).

Interior gasket 200 may also include one or more locating tabs 218 (e.g., three locating tabs 218)) that each fit into a corresponding locating recess 132 of lid upper portion 100. This can help with proper alignment of interior gasket 200 within recess 104 and restrain against relative movement between interior gasket 200 and lid upper portion 100 during motion relative to lid base 400. In some embodiments, locating tab 218 is disposed opposite drinking passage opening 204, which also helps with such alignment, so that location alignment is evenly distributed around interior gasket 200. Interior gasket 200 may also include a removal tab 220, which can protrude from recess 104 or otherwise be positioned for a user to grasp removal tab 220 for pulling interior gasket 200 out of gasket recess 104 during disassembly.

Internal gasket 200 may define a drinking passage opening 204, which may fit tightly around drinking passage 102 of lid upper portion 100 (e.g., by an interference fit). This tight fit and the contact of protrusions 212 against platform 406 of lid base 400 provide a liquid-tight passageway from interior 706 of container 700 through drinking passage 102 of lid upper portion 100 when drinking vessel 10 is in a drinking mode. For example, FIG. 9 shows drinking vessel 10 in the first drinking mode, in which drinking passage 102 is aligned with first fluid passage 402. Arrow 32 extends through the liquid-tight passageway. If a user were to tip drinking vessel 10 sufficiently in the direction of drinking passage 102, liquid within drinking vessel 10 would flow through first fluid passage 402 of lid base 400, through drinking opening 204 of internal gasket 200 (sealed against both lid base 400 and lid upper portion 100), through drinking passage 102 of lid upper portion 100, and out of drinking vessel 10.

Lid upper portion 100 is disposed above internal gasket 200, and interconnects with lid base 400. Lid upper portion 100 may be formed of a food grade material such as, for example, food-grade plastic (e.g., polypropylene, copolyester, the copolymer sold as Eastman Tritan, high-density polyethylene (HDPE), polyoxymethylene (POM), or acrylonitrile butadiene styrene (ABS)), glass, or metal (e.g., steel, stainless steel, aluminum, copper, or titanium), and may be formed as a single, unitary piece. As shown, for example, in FIG. 8, lid upper portion 100 includes a central vertical cylinder 116, which extends down into central recess 408 of lid base 400. An outer, lower portion of central vertical cylinder 116 defines connection grooves 118, which cooperate with protrusions 432 disposed at a lower portion of inner cylindrical wall 424 of lid base 400 to connect lid upper portion 100 to lid base 400 and to help maintain their vertical alignment during movement by preventing vertical motion of lid upper portion 100 relative to lid base 400 except when lid 20 is in disassembly mode.

Lid upper portion 100 includes registration bumps 106 on an inner side of its central vertical cylinder 116. Registration bumps 106 interact with recesses 306 of selector spring 300's deflection arms 302 to provide tactile and/or audible feedback to a user during rotation of lid upper portion 100 relative to lid base 400, to help a user know when drinking vessel 10 is aligned in a particular mode. Such interaction will be discussed in more detail below.

Lid upper portion 100 may define a central opening 120, through which indicator 308 may be viewed. For example, a portion of selector spring 300 carrying indicator 308 may extend through opening 120. Alternatively, indicator 308 may be viewed through a transparent portion of lid upper portion 100. As mentioned above, selector spring 300 is rotationally restrained relative to lid base 400, so that lid upper portion 100 moves relative to selector spring 300 at the same time and rate that it moves relative to lid base 400. The portion of selector spring 300 visible through opening 120 may include an indicator 308. Lid upper portion 100 may include selection indicia 110, each corresponding to a mode of lid 20 (and consequently of its drinking vessel 10), positioned around central opening 120. Indicator 308 may point to one of selection indicia 110 to indicate the current mode of lid 20. Rotation of lid upper portion 100 to a new mode will cause indicator 308 to point to a different selection indicium 110 representing the new mode. In this way, a user can always be apprised of the current mode of their drinking vessel 10.

Lid upper portion 100 may define drinking passage 102. Drinking passage 102 may extend from a location at or near platform 406 of lid base 400 when lid upper portion 100 and lid base 400 are assembled (see, e.g., FIG. 9) through lid upper portion 100 to a discharge opening located in a drinking spout 122. The bottom end of drinking passage 102 may be in contact with and surrounded by drinking passage opening 204 of internal gasket 200, which may in turn be in contact with platform 406 of lid base 400, creating a seal therewith. In some embodiments a lower opening of drinking passage 102 has a size and a shape matching those of one or both of first fluid passage 402 and second fluid passage 404, to allow for a similar rate of fluid passage therethrough.

Lid upper portion 100 may define drinking spout 122, through which drinking passage 102 extends (see, e.g., FIGS. 1 and 7). Drinking spout 122 may form a part of an upper rim 124 of lid upper portion 100. A distance from upper rim 124 to container 700 may be greater at drinking spout 122 than at any other position along upper rim 124 (and thus drinking vessel 10 may be tallest at drinking spout 122). This can help a user readily identify the position of drinking spout 122. Drinking spout 122 may define a lower lip rest 112, upon which a user may rest their lower lip during drinking, and an upper lip rest 114, upon which a user may rest their upper lip when drinking. Lower lip rest 112 may define a recess relative to an outer side wall 128 of lid upper portion 100. Lower lip rest 112 may be concave. Upper lip rest 114 may define a bulge relative to inner side of upper rim 124, for example when viewed from above. Upper lip rest 114 may be concave, for example when viewed in cross section at a plane intersecting axis 30. Together, lower lip rest 112 and upper lip rest 114 allow a user to form a seal around drinking spout 122 with their lips, to allow for easy and natural sucking of a beverage from within drinking vessel 10 in the second drinking mode. At the same time, the positioning and integration of drinking spout 122 in upper rim 124 of lid upper portion 100 allow a user to naturally drink from upper rim 124 just as they would from the rim of a cup (e.g., a tumbler). Thus, drinking spout 122 allows for natural use of drinking vessel 10 by a user whether in the first drinking mode or in the second drinking mode. In some embodiments drinking spout 122 is disposed elsewhere in lid upper portion (e.g., centrally, or at a position between a rim and a center).

Selector spring 300 is disposed between and interacts with lid upper portion 100 and lid base 400. Selector spring 300 may be formed of food-grade plastic (e.g., polypropylene, copolyester, the copolymer sold as Eastman Tritan, high-density polyethylene (HDPE), polyoxymethylene (POM), or acrylonitrile butadiene styrene (ABS)), glass, or metal (e.g., steel, stainless steel, aluminum, copper, or titanium), and may be formed as a single, unitary piece or as multiple pieces. As shown, for example, in FIGS. 2, 3, 7, and 8, registration portions 318 of selector spring 300 are disposed within receiving grooves 420 of locating structure 418, so that movement (e.g., rotation) of selector spring 300 relative to lid base 400 is limited or prevented. Selector spring 300 may be constrained vertically by an overlying portion of lid upper portion 100. For example, a flange 316, which may extend around an optional top panel 314, may be disposed under and in contact with a flange 130 of lid upper portion 100 extending around central opening 120, such that flange 316 cannot pass through opening 120. Selector spring 300 may be disposed within central recess 408 of lid base 400, if present. Selector spring 300 can have a central column 304 formed by optional top panel 314 (on an upper surface of which indicator 308 can be disposed) and column flanges 310 extending down from outer edges of top panel 314. Column flanges 310 extend down to contact floor 416 of central recess 408, and may connect directly with the registration portions 318. Selector spring 300 may also include a support 312, which may be formed as a peg, disposed within receiving cylinder 422 of locating structure 418. Support 312 may help facilitate assembly by cooperating with receiving cylinder 422 to help locate selector spring 300 within central recess 408.

Although indicator 308 can be carried by or formed as part of selector spring 300, indicator 308 can be carried by or formed as part of a separate component. For example, indicator 308 can be carried by or formed as part of lid base 400. When indicator 308 is separate from lid base 400 and selector spring 300, indicator 308 may be attached to lid base 400 so that its position and orientation are determined by the position and orientation of lid base 400 relative to lid upper portion 100.

Selector spring 300 may include deflection arms 302. Each deflection arm 302 may extend between registration portions 318. Deflection arms 302 may each form a segment of an arc or a circular shape around locating structure 148, corresponding with an inner shape of central vertical cylinder 116 of lid upper portion 100, within which deflection arms 302 are disposed. Deflection arms 302 may define recesses 306 in their outer surfaces, such recesses 306 sized, shaped, and positioned to receive registration bumps 106 of lid upper portion 100, for example in some or all of the closed and drinking modes. When lid upper portion 100 moves relative to selector spring 300, deflection arms 302 deflect inward as registration bumps 106 press against them, until registration bumps 106 reach the next recesses 306 and register in place by deflection arms 302 moving back to their original position. In moving back to their original position, deflection arms 302 may rapidly move against registration bumps 106 (e.g., as in a detent mechanism) such that they click into place. Such clicking into place can be felt, heard, or both by a user, and thus can provider tactile feedback, audible feedback, or both so that the user knows that drinking vessel 10 is aligned in a particular drinking mode. In some embodiments, the user can look at indicator 308 to confirm which mode (as discussed above).

Registration bumps 106 and recesses 306 may be positioned such that multiple registration bumps 106 and recesses 306 align simultaneously, including such that all registration bumps 106 and recesses 306 align simultaneously. In some embodiments, there may be an even number of registration bumps 106 and recesses 306. In some embodiments each registration bump 106 is disposed directly across from another registration bump 106 (e.g., relative to axis 30), and each recess 306 is disposed directly across from another recess 306 (e.g., relative to axis 30). Such even positioning can help promote even feedback and an even feel to a user turning lid upper portion 100. For example, as shown in the figures, lid upper portion 100 may include six registration bumps 106, and selector spring 300 may include six recesses 306.

Figure 10:
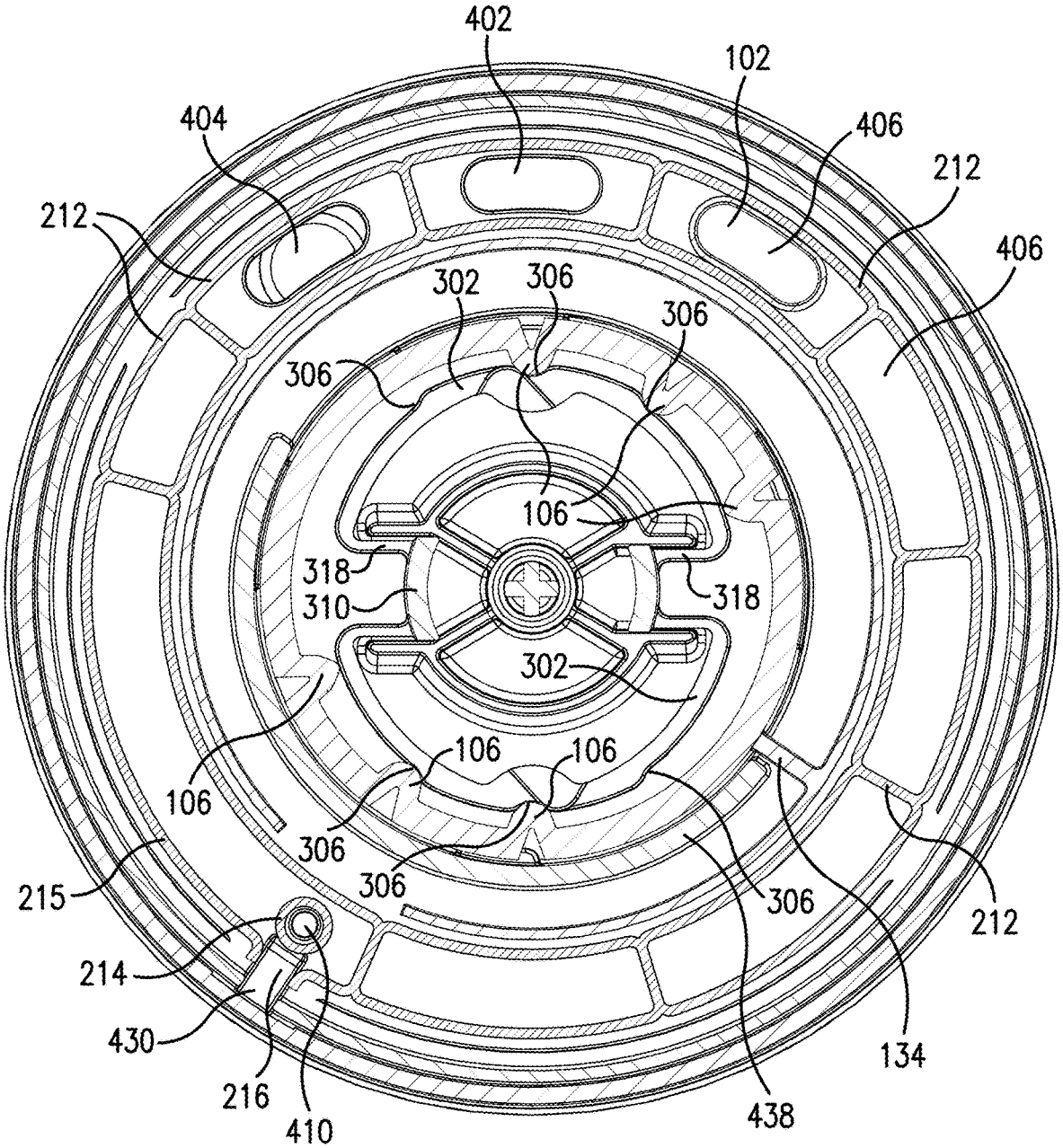
FIG. 10 shows a horizontal sectional view of the drinking vessel of FIG. 1 in a closed mode, taken at the position of line X-X of FIG. 9.
Figure 11:
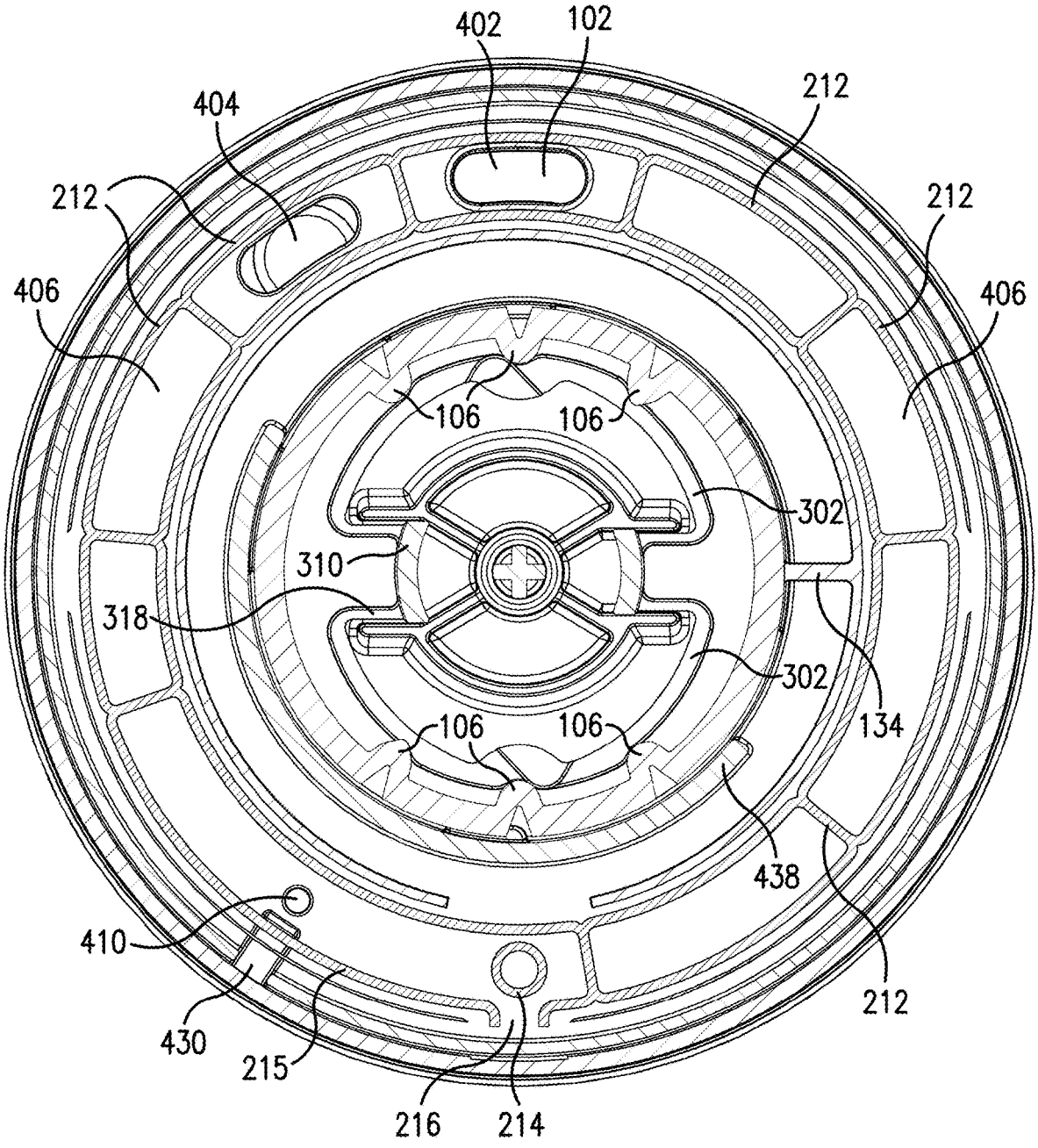
FIG. 11 shows a horizontal sectional view of the drinking vessel of FIG. 1 in a first drinking mode, taken at the position of line X-X of FIG. 9.
Figure 12:
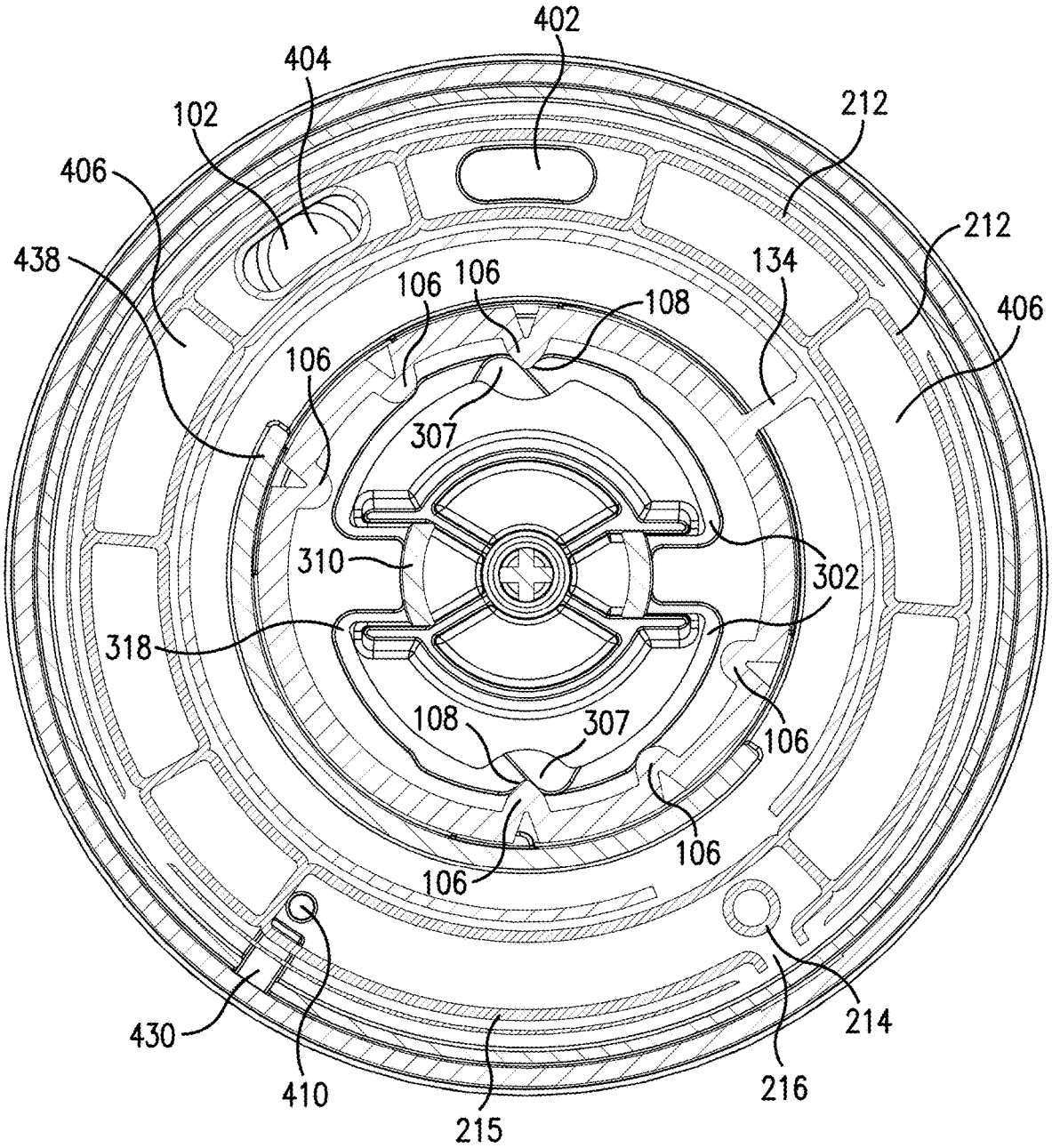
FIG. 12 shows a horizontal sectional view of the drinking vessel of FIG. 1 in a second drinking mode, which employs a straw, taken at the position of line X-X of FIG. 9.

The operation of registration bumps 106 and recesses 306 and the positions of drinking passage 102, first fluid passage 402, and second fluid passage 404 in the closed mode, first drinking mode, second drinking mode, and disassembly mode will be described in more detail with reference to FIGS. 10-13 below. FIGS. 10-13 are cross-sectional views taken horizontally through assembled drinking vessel 13, at a plane intersecting protrusions 212 of internal gasket 200 (i.e., just above platform 406 of lid base 400). In FIG. 10 drinking vessel 10 is in a closed mode. In FIG. 11 drinking vessel 10 is in a first drinking mode. In FIG. 12 drinking vessel 10 is in a second drinking mode. And in FIG. 13 drinking vessel 10 is in a disassembly mode.

As shown in FIG. 10, drinking passage 102 is aligned with neither of first fluid passage 402 nor second fluid passage 404. Instead it is sealed against platform 406 by protrusions 212 of internal gasket 200. Also, closed vent protrusion 214 is disposed and seals around vent hole 410. Nearer the center of the figure, registration bumps 106 of lid upper portion 100 are shown registered within recesses 306 of selector spring 300. This registration helps inhibit inadvertent movement (e.g., rotation) of lid upper portion 100 relative to lid base 400. In the example embodiment shown, the left-most of the upper three registration bumps 106 is received within the central of the upper three recesses 306, the central of the upper three registration bumps 106 is received within the right-most of the upper three recesses 306, and the right-most of the upper three registration bumps 106 is not received by a recess 306. ("Upper" is used in this context to refer to position on the page, for explanatory purposes.)

In FIG. 11, lid upper portion 100 has been rotated counterclockwise relative to lid base 400 from the position shown in FIG. 10. Now the left-most of the upper three registration bumps 106 is received within the left-most of the three upper recesses 306, the central of the upper three registration bumps 106 is received within the central of the upper three recesses 306, and the right-most of the upper three registration bumps 106 is received within the right-most of the upper three recesses 306. In travelling to this location, registration bumps 106 pressed against and deflected deflection arms 302 until registration bumps 106 and recesses 306 were aligned once more, at which point deflection arms 302 sprung back to their original position, as shown in FIG. 11, creating tactile and/or audible feedback to the user. As can be seen, drinking passage 102 rotated along with registration bumps 106 (since they all are part of lid upper portion 100), such that drinking passage 102 is aligned with first fluid passage 402. In this first drinking mode, drinking passage 102 communicates with interior 706 of container 700 above its liquid when drinking vessel 10 is upright, so a user can simply pour liquid out of drinking vessel 10 through drinking passage 102, as discussed above. Also in this first drinking mode, drinking passage 404 is disposed within a protrusion 212 of internal gasket 200. In this position internal gasket 200 seals an area around drinking passage 404, such that fluid does not flow through drinking passage 404 past internal gasket 200.

Additionally, closed vent protrusion 214 moved along with lid upper portion 100 from the position shown in FIG. 10 to the position shown in FIG. 11 such that closed vent protrusion 214 is moved off of vent hole 410, and no longer seals vent hole 410 (in other words, vent hole 410 is outside of the space enclosed by closed vent protrusion 214, and is inside a space defined by open vent protrusion 215). In this position, vent hole 410 is in fluid communication with an external atmosphere of drinking vessel 10, allowing air to enter to take the place of liquid that is displaced through drinking passage 102. This helps keep a steady flow of liquid through drinking passage and minimizes vacuum buildup that could interrupt the flow. Air may enter drinking vessel 10, for example, through vent trench 430 or through a discontinuity 216 in open vent protrusion 215 of internal gasket 200 surrounding vent hole 410. As shown, vent trench 430, if present, may be a recess in lid base that extends from an area adjacent vent hole 410 to an area outside of internal gasket 200 that is outside the seal otherwise formed by internal gasket 200. Discontinuity 216, if present, likewise may allow outside air through a chamber defined by its open vent protrusion 215, where vent hole 410 is within that chamber.

In FIG. 12, lid upper portion 100 has been rotated counterclockwise relative to lid base 400 from the position shown in FIG. 11. Now the left-most of the three upper registration bumps 106 is not received by a recess 306 of selector spring, the central of the upper three registration bumps 106 is received by the left-most of the upper three recesses 306, and the right-most of the upper three registration bumps 106 is received by the central of the upper three recesses 306. Similarly as described above with reference to FIG. 11, the rotation of lid upper portion 100 from the FIG.

11 position to the FIG. 12 position caused registration bumps 106 to press against and deflect deflection arms 302 until they were aligned once more, and deflection arms 302 sprung back to their original position, creating a tactile and/or audible feedback to a user signaling that drinking vessel 10 is properly aligned in the second drinking mode. In this second drinking mode, which employs straw 600, drinking passage 102 is aligned with second fluid passage 404, and drinking passage 102 communicates with interior 706 of container 700 below its liquid level via straw 600 connected to second fluid passage 404 when drinking vessel 10 is upright. In this position a user can suck on drinking spout 122 to draw liquid up through straw 600 and into the user's mouth for consumption via second fluid passage 404 and drinking passage 102. Also in this second drinking mode, drinking passage 402 is disposed within a protrusion 212 of internal gasket 200. In this position internal gasket 200 seals an area around drinking passage 402, such that fluid does not flow through drinking passage 402 past internal gasket 200.

Additionally, closed vent protrusion 214 moved along with lid upper portion 100 from the position shown in FIG. 11 to the position shown in FIG. 12, but vent hole 410 is still outside of closed vent protrusion 214, and not sealed by it. Air intake to take the place of displaced liquid occurs the same way as described above with reference to FIG. 11 for the first drinking mode.

Figure 13:
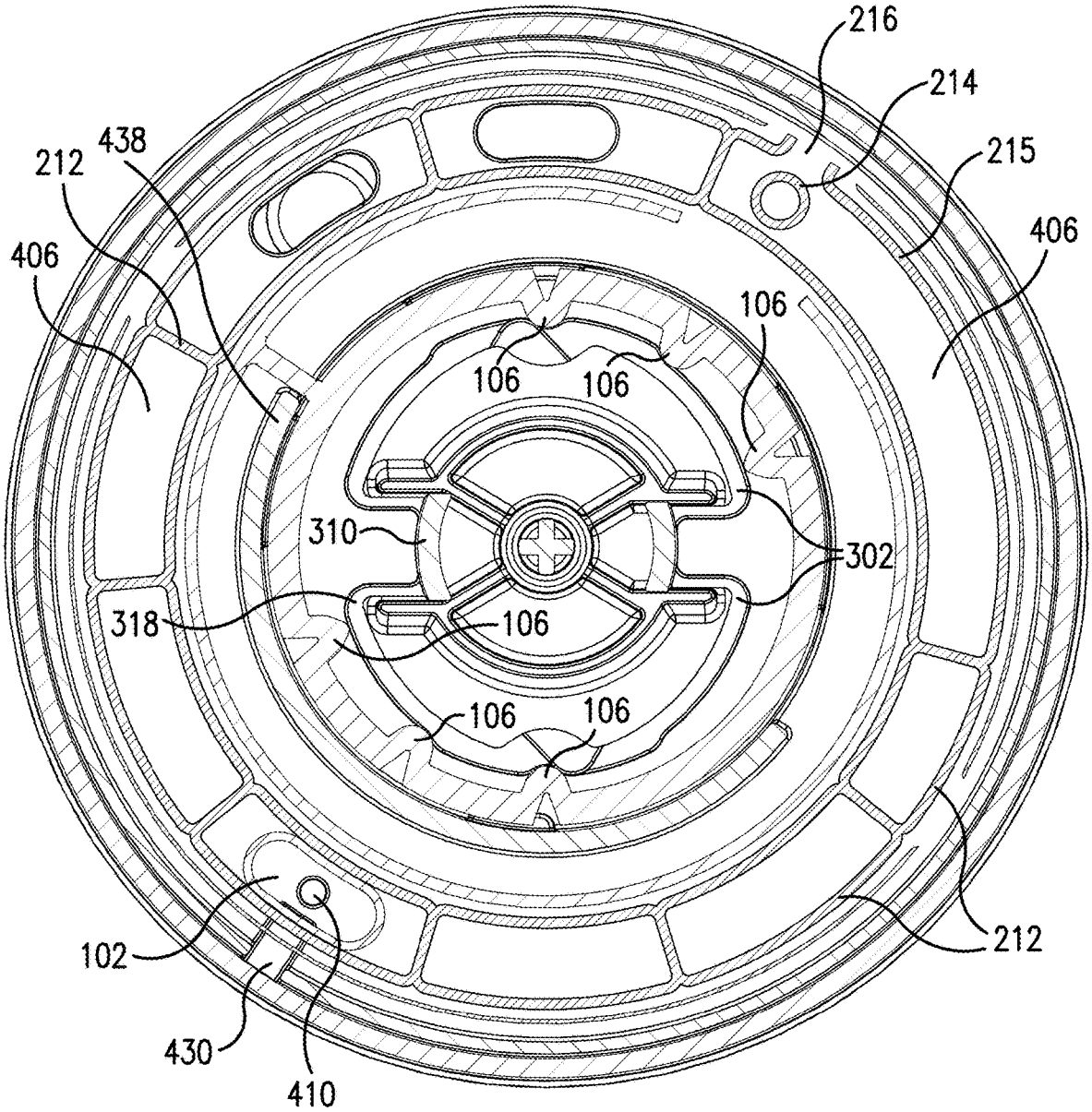
FIG. 13 shows a horizontal sectional view of the drinking vessel of FIG. 1 in a disassembly mode, taken at the position of line X-X of FIG. 9.

In FIG. 13, lid upper portion 100 has been rotated counterclockwise relative to lid base 400 from the position shown in FIG. 12 until the first of the formerly-upper registration bumps 106 reaches and is received by the central of the lower three recesses 306. In some embodiments, in moving from the previous position to the disassembly position shown in FIG. 13, a secondary registration bump 108 (see FIG. 8) passes a raised recess portion 307. Secondary registration bump 108 may be disposed on a registration bump 106, and protrude out further than registration bumps 106. Secondary registration bump 108 may not extend a full length of the registration bump 106 on which it is disposed. Instead, it may be disposed above a portion of registration bump 106 that engages with recesses 306. In this position, secondary registration bump 108 only engages with raised recess portion 307. Raised recess portion 307 and secondary registration bump 108 may have a deeper interference than registration bumps 106 and recesses 306, thus requiring more force to move secondary registration bump 108 over raised recess portion 307. This can provide a stronger and/or louder feedback to a user, which may be used to signal to the user that lid 20 has been moved toward a particular mode (e.g., a disassembly mode). This difference in feedback can be useful to help prevent inadvertent disassembly, for example, since a user will feel more resistance.

In the disassembly position shown in FIG. 13, connection grooves 118 of lid upper portion 100 are not vertically engaged with protrusions 432 of lid base 400 (see, e.g., FIGS. 7 and 8), which allows the user to disassemble drinking vessel 10 by vertically removing lid upper portion 100, which vertically frees interior gasket 200 and selector spring 300 for removal from their positions between lid upper portion 100 and lid base 400. Lid base 400 can be removed from container 700 by overcoming the press-fit of outer gasket 500, which can then be stretched out of outer channel 426 of lid base 400.

As discussed above, lid 20 can be formed of five unitary components: lid upper portion 100, internal gasket 200, selector spring 300, lid base 400, and outer gasket 500. By utilizing unitary components in such a way as has been described above, assembly and disassembly by a user can be simply and intuitively achieved. The user will benefit from having a small number of parts to disassemble, wash, and reassemble. The construction described above also allows each part to be formed large enough that it is easy for a user to keep track of and not to inadvertently lose during such disassembly and washing.

Drinking vessel 10 has been discussed above primarily with reference to lid 20 having two drinking modes. However, in some embodiments lid 20 may be formed with fewer or more than two drinking modes. In the case where lid 20 is formed with fewer than two drinking modes, either the first drinking mode (and associated structures) or the second drinking mode (and associated structures) may be eliminated, and lid 20 may operate with a single drinking mode and a closed mode (and optionally, a disassembly mode). For example, lid base 400 may include a single fluid passage. In some embodiments the single fluid passage may be connected to a straw. In some embodiments the single fluid passage may not be connected to a straw.

It is to be appreciated that the Detailed Description section, and not the Summary and Abstract sections, is intended to be used to interpret the claims. The Summary and Abstract sections may set forth one or more but not all exemplary embodiments of the disclosed invention(s) as contemplated by the inventor(s), and thus, are not intended to limit the disclosed invention(s) and the appended claims in any way.

The foregoing description of the specific embodiments will so fully reveal the general nature of the claimed invention that others can, by applying knowledge within the skill of the art, readily modify and/or adapt for various applications such specific embodiments, without undue experimentation, without departing from the general concept of the claimed invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the claimed invention should not be limited by any of the above-described exemplary embodiments, but should be defined only in accordance with the claims and their equivalents.

What is claimed is:

1. A drinking vessel with selectable modes, comprising:
- a container having an upper opening;
- a lid disposed over the upper opening of the container, the lid comprising:
  - a lid upper portion defining a drinking passage therethrough, the drinking passage disposed at an upper rim of the lid upper portion and offset from a central vertical axis of the drinking vessel;
  - a lid base having a first fluid passage and a second fluid passage; and
- a straw in fluid communication with the second fluid passage;
- wherein the lid upper portion is rotatable to at least three positions relative to the lid base,
- wherein in a first position the drinking passage does not align with either the first fluid passage or the second fluid passage,
- wherein in a second position the drinking passage aligns with the first fluid passage, and wherein in a third position the drinking passage aligns with the second fluid passage.

2. The drinking vessel of claim 1, wherein the lid upper portion must rotate through the second position to get from the first position to the third position.

3. The drinking vessel of claim 1, wherein the container is a tumbler, and wherein the lid is coupled to the container by a press fit.

4. The drinking vessel of claim 1, wherein the lid further comprises an internal gasket disposed between the lid upper portion and the lid base, wherein the internal gasket is annular, defining a first opening disposed around a central vertical axis of the drinking vessel, and defining a second opening around a bottom end of the drinking passage, wherein the internal gasket and the lid upper portion rotate together relative to the lid base.

5. The drinking vessel of claim 4, wherein the internal gasket comprises:

fins extending upward from an upper surface of the internal gasket, wherein the fins are oriented radially; and protrusions extending downward from a lower surface of the internal gasket, each of the protrusions defining the perimeter of a closed arcuate shape, wherein the fins are received within a recess of the lid upper portion, wherein the protrusions press against an upper surface of the lid base, wherein the protrusions slide along the upper surface of the lid base when the lid upper portion rotates relative to the lid base, and wherein one of the protrusions extends around the second opening of the internal gasket.

6. The drinking vessel of claim 1, wherein the lid further comprises a selector spring disposed within a central recess of the lid base, wherein the selector spring and the lid base rotate together relative to the lid upper portion, wherein the selector spring has a deflection arm in contact with an internal selector feature of the lid upper portion, and wherein the selector spring and the internal selector feature together form a detent mechanism that provides tactile feedback when the lid upper portion is rotated into the first position, the second position, or the third position.

7. The drinking vessel of claim 6, wherein the selector spring comprises:

a central column that extends upward through an opening of the lid upper portion; and a second deflection arm, wherein the first deflection arm and the second deflection arm are disposed at a bottom of the column, on opposite sides of the column, wherein the first deflection arm and the second deflection arm together form portions of a circular shape, wherein each of the first deflection arm and the second deflection arm define recesses, each recess sized and shaped to receive an internal selector feature of the lid upper portion, and wherein rotation of the lid upper portion relative to the selector spring causes internal selector features of the lid upper portion to press against and deflect deflection arms until the internal selector features align with and are received by recesses of the deflection arms.

8. The drinking vessel of claim 1, wherein the lid further comprises:

an internal gasket disposed between the lid upper portion and the lid base;

a selector spring disposed within a central recess of the lid base; and an outer gasket disposed and providing a seal between the lid and the container, wherein the internal gasket is annular, defining a first opening disposed around a vertical axis of the drinking vessel, and defining a second opening around a bottom end of the drinking passage, wherein the internal gasket and the lid upper portion rotate together relative to the lid base;

wherein the selector spring and the lid base rotate together relative to the lid upper portion, wherein the selector spring has a deflection arm in contact with an internal selector feature of the lid upper portion, and wherein the selector spring and the internal selector feature together form a detent mechanism that provides tactile feedback when the lid upper portion is rotated into the first position, the second position, or the third position.

9. The drinking vessel of claim 1, wherein the lid base further defines a vent hole therethrough, wherein in the second position and the third position the vent hole is in communication with both an interior of the container and with an atmosphere outside of the drinking vessel, and wherein in the first position the vent hole is in communication with the interior of the container and not with the atmosphere outside of the drinking vessel.

10. The drinking vessel of claim 9, wherein the lid further comprises an internal gasket disposed between the lid upper portion and the lid base, wherein the internal gasket comprises protrusions extending downward from a lower surface of the internal gasket, each of the protrusions defining the perimeter of an arcuate shape, wherein the protrusions press against a flat upper surface of the lid base, wherein the protrusions slide along the flat upper surface of the lid base when the lid upper portion rotates relative to the lid base, wherein one of the protrusions is a closed vent protrusion, and wherein the closed vent protrusion is disposed around and seals the vent hole in the first position, and wherein in the second position and the third position the vent hole is outside of the closed vent protrusion.

11. The drinking vessel of claim 9, wherein the lid further comprises an internal gasket disposed between the lid upper portion and the lid base, wherein the lid base forms a recessed vent trench extending from beneath the internal gasket to a position outside of the internal gasket, and wherein in the second position and the third position the vent hole is in communication with the atmosphere outside of the drinking vessel via the vent trench.

12. The drinking vessel of claim 1, wherein in the first position, the second position, and the third position the lid upper portion and the lid base cannot move vertically relative to each other, wherein the lid upper portion is rotatable to at least four positions relative to the lid base, and wherein in a fourth position the lid upper portion and the lid base can move vertically relative to each other and can be disassembled from each other.

13. The drinking vessel of claim 1, wherein the first fluid passage and the second fluid passage are offset from a central vertical axis of the drinking vessel.

14. The drinking vessel of claim 1, wherein the first fluid passage and the second fluid passage are positioned circumferentially around a central vertical axis of the drinking vessel.

15. A drinking vessel with selectable modes, comprising:

a container for containing a beverage; and a lid disposed on and extending over an upper opening of the container, wherein the lid is configurable into at least three modes:

a first mode, in which a drinking spout of the lid is not in communication with an interior of the container and in which the interior of the container is closed relative to an atmosphere outside of the container, a second mode, in which the drinking spout is in direct fluid communication with an interior of the container at a position directly below the lid, and a third mode, in which the drinking spout is in fluid communication with a straw coupled to the lid and extending downwardly within the container below the lid, wherein, to transition from the first mode to the third mode, the lid must be configured in the second mode before reaching the third mode.

16. The drinking vessel of claim 15, wherein the lid can be transitioned between the modes by rotating at least a portion of the lid relative to the container.

17. The drinking vessel of claim 15, wherein the drinking spout is offset from a central vertical axis of the drinking vessel.

18. The drinking vessel of claim 17, wherein the drinking spout is disposed at an upper rim of the lid.

19. A drinking vessel with selectable modes, comprising:

a tumbler; and a lid covering an upper opening of the tumbler, the lid comprising a single drinking spout, wherein, in a first drinking mode, the drinking spout is in fluid communication with an interior of the tumbler via a straw coupled to a bottom side of the lid, wherein, in a second drinking mode, the drinking spout is in fluid communication with the interior of the tumbler not via a straw, and wherein the drinking vessel can be moved between the first and the second drinking mode by rotating an upper portion of the lid such that the spout changes position along a circumference of the lid.

20. The drinking vessel of claim 19, wherein the tumbler has a smooth interior surface at its connection to the lid and the lid is press fit into the upper opening of the tumbler.

21. The drinking vessel of claim 19, wherein the straw is entirely disposed within the tumbler.

22. A drinking vessel with selectable modes, comprising:

a container having an upper opening;

a lid disposed over the upper opening of the container, the lid comprising:

a lid base having a first fluid passage and a second fluid passage;

a lid upper portion defining a drinking passage extending therethrough;

a straw in fluid communication with the second fluid passage; and an internal gasket disposed between the lid upper portion and the lid base, the internal gasket defining an opening surrounding a bottom end of the drinking passage, wherein the lid upper portion is rotatable to at least three positions relative to the lid base, wherein in a first position the drinking passage does not align with either the first fluid passage or the second fluid passage, wherein in a second position the drinking passage aligns with the first fluid passage, wherein in a third position the drinking passage aligns with the second fluid passage, and wherein the internal gasket and the lid upper portion rotate together relative to the lid base.

23. A drinking vessel with selectable modes, comprising:

a container having an upper opening; and a lid disposed over the upper opening of the container, the lid comprising:

a lid upper portion defining a drinking passage therethrough, the drinking passage disposed at an upper rim of the lid upper portion; and a lid base connected to a straw, wherein the lid upper portion is rotatable to at least two positions relative to the lid base, wherein in the first position the drinking passage does not align with the straw, and wherein in the second position the drinking passage aligns with the straw.

* * * * *